United States Patent [19]

Onishi et al.

[11] Patent Number: 4,615,932

[45] Date of Patent: Oct. 7, 1986

[54] MULTI-GRADATION HEAT SENSITIVE TRANSFER MEDIUM

[75] Inventors: Masaru Onishi, Kamakura; Masayuki Saito, Fujisawa; Yoshikazu Shimazaki, Osaka, all of Japan

[73] Assignees: Mitsubishi Denki Kabushiki Kaisha, Tokyo; Fuji Kagakushi Kogyo Co., Ltd., Osaka, both of Japan

[21] Appl. No.: 601,406

[22] Filed: Apr. 17, 1984

[51] Int. Cl.[4] ..... B41M 5/26

[52] U.S. Cl. ..... 428/207; 428/195; 428/212; 428/484; 428/488.1; 428/913; 428/914

[58] Field of Search ..... 428/195, 201, 204, 212, 428/913, 914, 207, 211, 321.3, 484, 488.1, 488.4

[56] References Cited

U.S. PATENT DOCUMENTS 4,492,965 1/1985 Ohnishi et al. ..... 346/1.1

OTHER PUBLICATIONS

Gakkai, Technical Report IE 81-63, pp. 45-52, Sep. 25, 1981.

*Primary Examiner*—Bruce H. Hess

*Attorney, Agent, or Firm*—Armstrong, Nikaido, Marmelstein & Kubovcik

[57] ABSTRACT

A multi-gradation heat sensitive transfer medium for use in multi-gradation thermal transfer for adjusting the density of a transfer print image by superimposing ink layers on a recording medium a plurality of times by thermal transfer, which comprises a foundation and ink layers provided thereon, each of said ink layers containing a color pigment having a high transparency and a high tinting strength in an amount smaller than sufficient to provide a maximal degree of reflection density, and each of said ink layers having a light transmittance of not less than about 65% in a region where the color pigment does not have any absorption band. By superimposing the ink layers of the transfer medium on a recording medium a plurality of times, there is obtained a clear print image having a multiplicity of gradations.

5 Claims, 4 Drawing Figures

MULTI-GRADATION HEAT SENSITIVE TRANSFER MEDIUM

BACKGROUND OF THE INVENTION

The present invention relates to a heat sensitive transfer medium for use in a multi-gradation printing process in which the density of a print image can be changed. More particularly, it relates to a multi-gradation heat sensitive transfer medium for use in a multi-gradation thermal transfer process for adjusting the density of a transfer image by superimposing ink layers on a recording medium a plurality of times by thermal transfer.

As a conventional multi-gradation thermal transfer method, there is known a technique commonly called 3 L method (see Japan Denshi Tsushin Gakkai's technical report IE 81-63, p 45 to 52, Sept. 25, 1981).

This 3 L method is intended to obtain a multiplicity of gradations through combinations of dot number variations in a picture element with reflection density variations in thermally transferred ink layers. With this method, however, it has been very difficult to obtain a multiplicity of image gradations close to natural tones and yet having a high degree of resolution, becuase it has a limitation in the adjustment of reflection density of the ink layers and because the number of dots is subject to limitation relative to resolution.

In order to overcome the drawback of the 3L method, there may be considered a method in which printing is carried out by superimposing ink layers of the same color which have the same density or different densities, thereby adjusting the density of the print image. According to this method, it is possible to use the number of times of superimposing as a means for providing multi-gradation and to improve resolution by decreasing the number of dots per picture element but yet obtain a some number of gradations.

However, such multi-gradation method utilizing superimposing printing technique has a disadvantage that the density of a subsequently transferred ink layer produces a stronger effect than that of a previously transferred ink layer so that it is difficult to obtain a progressive increase in density, thus the print image produced being likely to be of a foggy and light tone even at a maximum reflection density.

SUMMARY OF THE INVENTION

The object of this invention is to overcome such difficulty and make it possible to obtain clear print images of a multiplicity of gradations by thermal transfer printing.

This and other objects of the invention will become apparent from the description hereinafter.

To this end, the invention provides a heat sensitive transfer medium having improved thermal transfer ink layers each of which contains a color pigment having a high transparency and a high tinting strength in an amount smaller than sufficient to provide a maximal degree of reflection density, and has a light transmittance of not less than 65% in a region where the color pigment does not have any absorption band.

DETAILED DESCRIPTION

By printing the above-mentioned specific ink layers so that they are superimposed with each other on a recording medium, it is possible to obtain a print image having high reflection density, much higher in the upper limit thereof than any conventionally produced print image, and which is very clear and visually free of foggy and fuzzy tone.

In this invention, the amount of color medium of an ink layer defined below must be less than sufficient to give a maximal degree of reflection density to a print image, since if it exceeds the upper limit of reflection density for the image in the particular color, multi-gradation is not attainable.

The amount of color medium is defined as follows:

$$\text{Amount of color medium (g/m}^2\text{)} = \frac{\left(\begin{array}{c}\text{Color pigment content}\\ \text{(\% by weight)}\end{array}\right) \times \left(\begin{array}{c}\text{Amount of coating}\\ \text{(g/m}^2\text{)}\end{array}\right)}{100}$$

The maximal degree of reflection density of a print image is intended to mean the upper limit that reflection density never exceeds even if the amount of color medium is increased by any amount over the limit.

The visible light transmittance of each ink layer in a region where a color pigment used does not have any absorption band (hereinafter this region is referred to as "non-absorption band") should be not less than about 65%, preferably not less than 70%. If it is lower than 65%, the upper level of reflection density of the image produced can never be sufficient, and no clear print image can be obtained either. The light transmittance is preferably as high as feasible.

Printing using the transfer medium of the present invention is carried out by melt-transferring the ink layer of the transfer medium in the form of dots on a recording medium by means of a thermal head having a plurality of heating elements. In the invention, the superimposing of ink layers is intended to mean that the dots of an ink layer subsequently transferred are substantially superimposed over the dots of an ink layer transferred previously on a recording medium.

The present invention is more particularly described and explained by means of the following Examples. These Examples are intended to illustrate the invention and not be construed to limit the scope of the invention. It is to be understood that various changes and modifications may be made in the invention without departing from the spirit and scope thereof.

EXAMPLE 1

Figure 1:
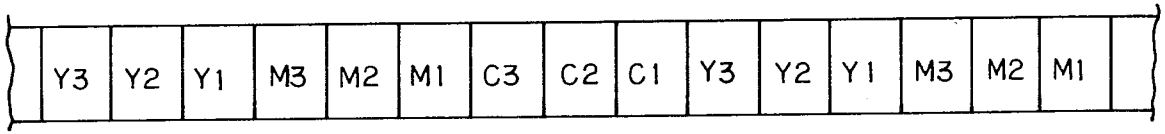
FIG. 1 is a schematic illustration showing an embodiment of a multi-gradation heat sensitive transfer medium according to the present invention wherein ink layers are arranged in color dandara pattern.

On a film base there were coated three partial ink layers Y1, Y2, Y3 in yellow Y; three partial ink layers C1, C2, C3 in cyan C; and three partial ink layers M1, M2, M3 in magenta M in a "Dandara" pattern as shown in FIG. 1 (Dandara: trademark of Fuji Kagakushi Kogyo Co., Ltd.). The three partial ink layers for each color were different from each other in the amount of color medium.

For the film base was used a polyester film having a thickness of 9μ. As a vehicle for the ink layers was used one having a high degree of transparency, the composition of which was as follows:

| Ingredient | % by weight |
|---|---|
| Carnauba wax No. 1 | 20 |
| Paraffin wax (melting point 65° C.) | 35 |
| Ester wax | 25 |
| Petroleum resin | 10 |
| Spindle oil | 10 |

As color mediums for the ink layers were used the following color pigments each having a high degree of transperency: cyanine blue for cyan, rhodamine lake Y for magenta, and benzidine yellow for yellow.

Table 1 shows the content of color pigment for each respective partial ink layer, and the reflection density (ΔOD) of a print image as thermally transferred one time by a thermal printer directly on a plain paper, and the light transmittance of each ink layer in the non-absorption band and the wavelength of the non-absorption band.

The reflection density (ΔOD) of a print image is defined as follows:

Reflection density (ΔOD) =
[Reflection density of a print image] −
[Reflection density of unprinted portion]

TABLE 1

| Partial ink layer | Color pigment content (% by weight) | Amount of coating ($g/m^2$) | Amount of color medium ($g/m^2$) | Reflection density (ΔOD) | Light transmittance in non-absorption band (%) | Wavelength of non-absorption band (nm) |
|---|---|---|---|---|---|---|
| Y1 | 8 | 3 | 0.24 | 1.0 | 80 | 440 |
| Y2 | 4 | 3 | 0.12 | 0.6 | * | 440 |
| Y3 | 2 | 3 | 0.06 | 0.36 | * | 440 |
| C1 | 6 | 3 | 0.18 | 1.0 | 95 | 610 |
| C2 | 3 | 3 | 0.09 | 0.65 | * | 610 |
| C3 | 1.5 | 3 | 0.045 | 0.40 | * | 610 |
| M1 | 7 | 3 | 0.21 | 1.03 | 92 | 570 |
| M2 | 3.5 | 3 | 0.105 | 0.68 | * | 570 |
| M3 | 1.8 | 3 | 0.054 | 0.42 | * | 570 |

*A decrease in amount of color medium resulted in an increase in light transmittance in non-absorption band.

Figure 2:
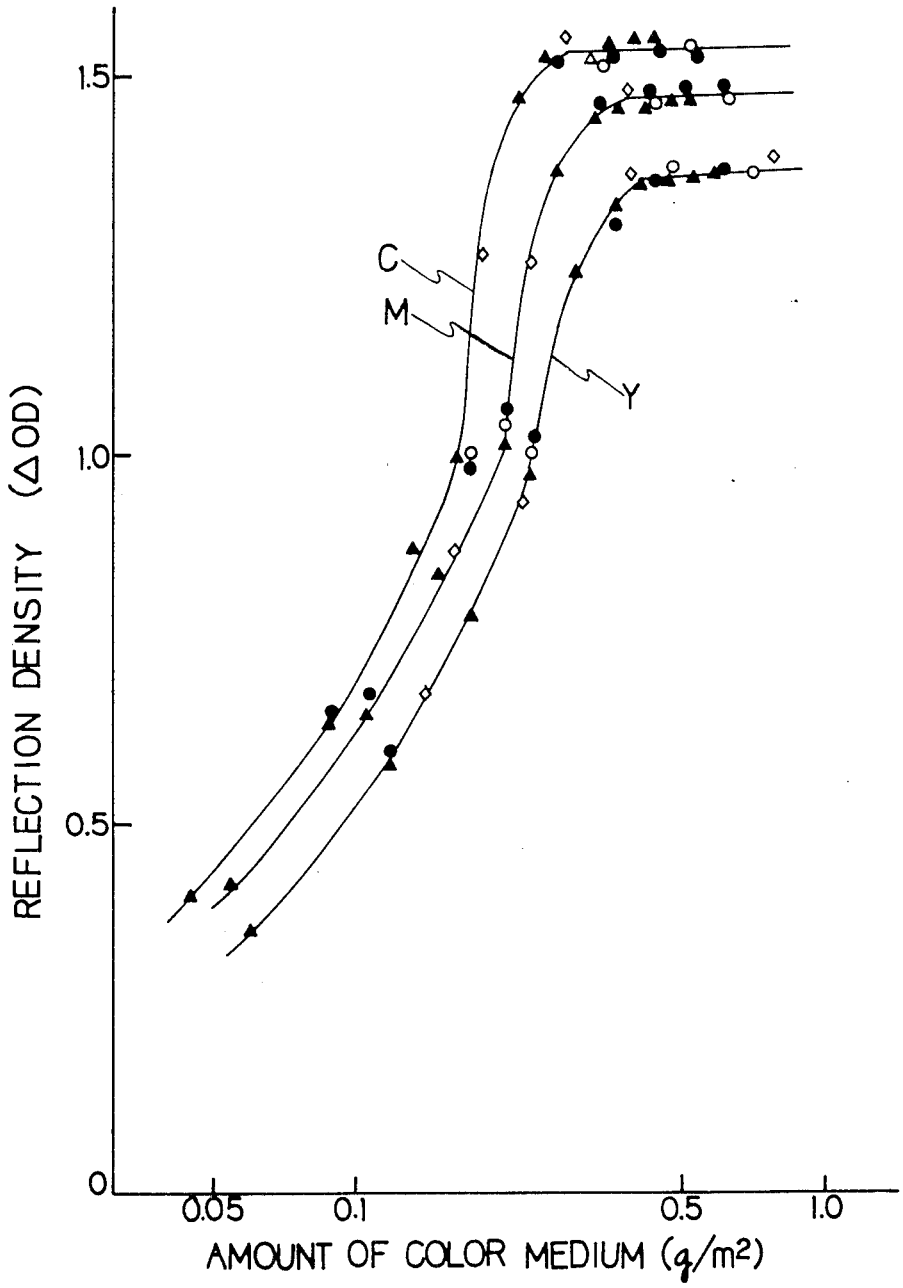
FIGS. 2, 3 and 4 are graphical representations showing the relation between reflection density (ΔOD) and amount of color medium with respect to print images as obtained in Examples 1 and 2 and Comparative Example, respectively.

Then, superimposing printing of the partial ink layers in each color was carried out two or more times by using a thermal printer. With respect to the print images thus obtained, the relationship between the reflection density (ΔOD) of the print image and the amount of color medium is graphically presented in FIG. 2. In FIG. 2 (as well as in FIGS. 3 and 4), the print images obtained from Y1, C1 or M1 are signified by mark ○, the print images obtained from Y2, C2 or M2 by mark ●, and the print images obtained from Y3, C3 or M3 by mark ▲.

As is clear from FIG. 2, with each color, once the amount of color medium exceeded a certain limit, the reflection density (ΔOD) of the print image produced never did exceed the certain value even if the amount of color medium was increased by any amount over the limit. About 10 gradations of print images were obtained for each color, each print image being found as having an exceptionally good definition.

EXAMPLE 2

The same procedures as in Example 1 except that 0.5 part by weight of titanium oxide was employed together with 1 part by weight of each color pigment as used in Example 1 were repeated to produce a multi-gradation heat sensitive transfer medium. Printing was carried out by using the obtained transfer medium in the same manner as described in Example 1. The relationship between the reflection density (ΔOD) of the print image produced and the amount of color medium is graphically shown in FIG. 3.

The light transmittance in non-absortion band was about 70% with a layer corresponding to the aforesaid ink layer Y1, about 76% with a layer corresponding to aforesaid ink layer C1, and about 73% with a layer coresponding to the aforesaid ink layer M1.

Figure 3:
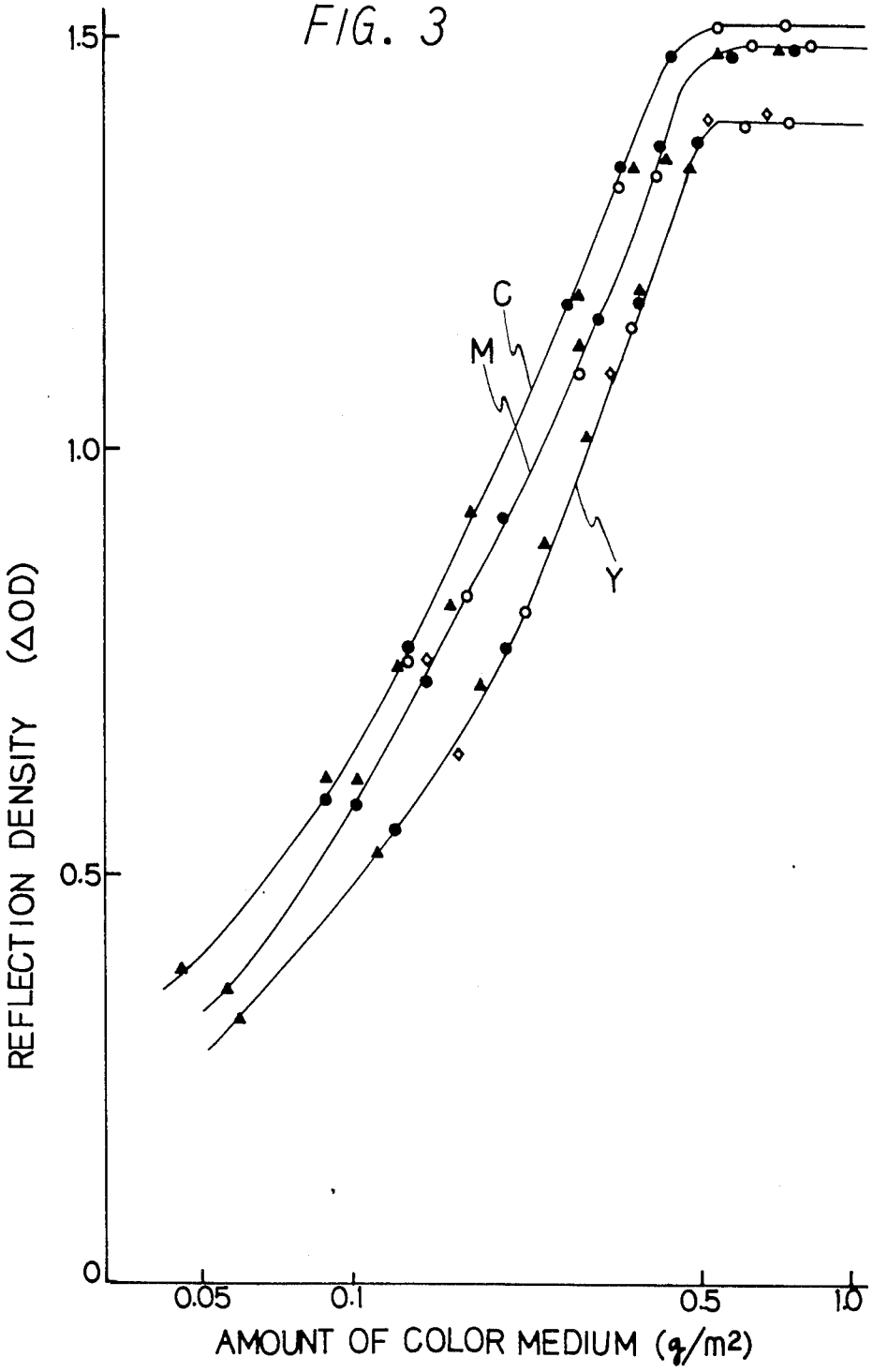

As is apparent from FIG. 3, a maximal value of reflection density (ΔOD) substantially as high as that in Example 1 was obtained for each respective color. Further, about 8 gradations of print iamges were obtained for each color, each print image being of an exceptionally good definition.

COMPARATIVE EXAMPLE

The same procedures as in Example 1 except that 4 parts by weight of titanium oxide was employed together with 1 part by weight of each color pigment as used in Example 1 were repeated to produce a multi-gradation heat sensitive transfer medium. The light transmittance in non-absorption band was about 45% with a layer corresponding to the aforesaid ink layer Y1, about 49% with a layer corresponding to the aforesaid ink layer C1, and about 47% with a layer corresponding to the aforesaid ink layer M1. Printing was carried out by using the obtained transfer medium in the same manner as described in Example 1. The relationship between the reflection density (ΔOD) of the print image obtained and the amount of color medium is graphically shown in FIG. 4.

Figure 4:
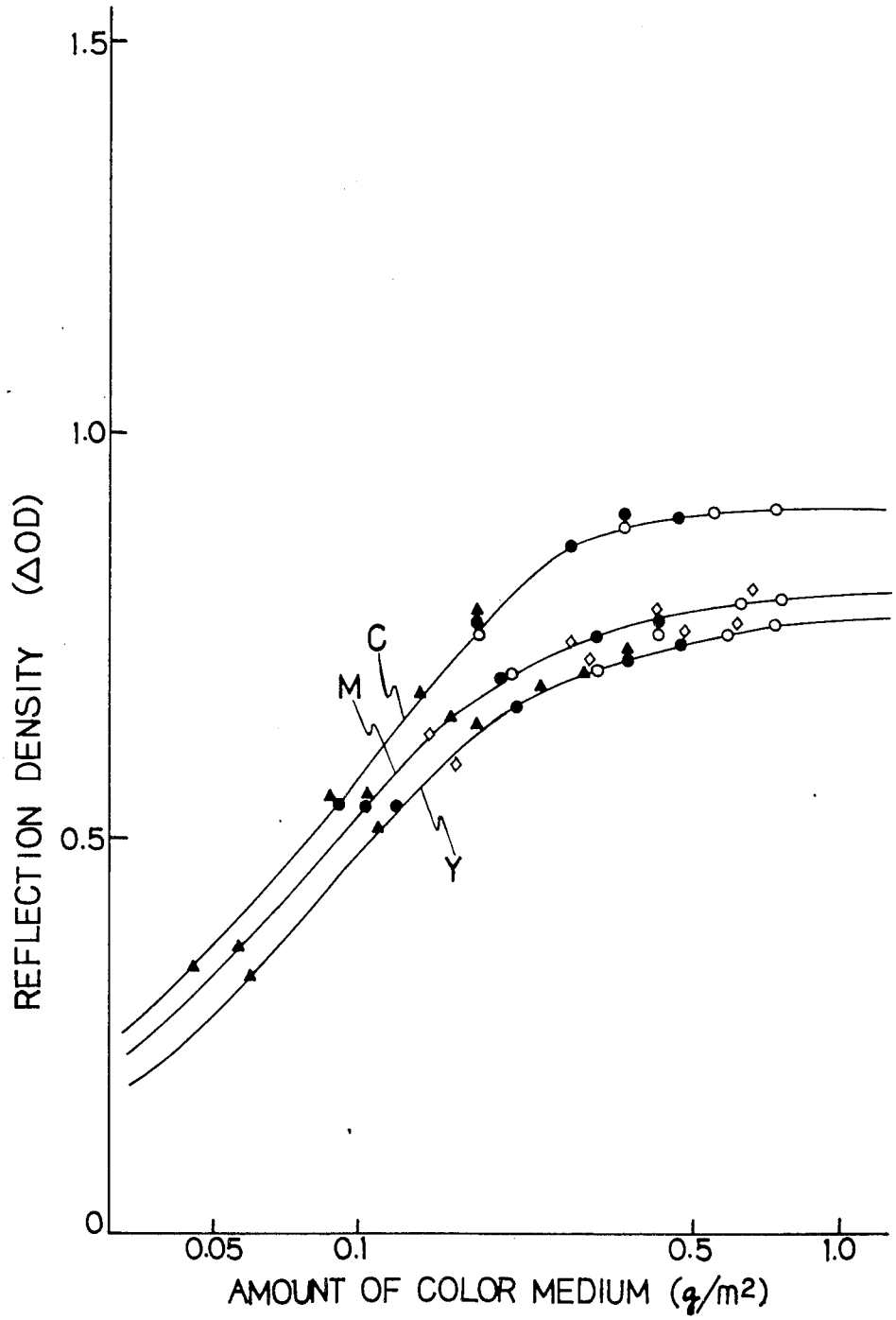

As can be clearly seen fom FIG. 4, the print image obtained in Comparative Example had a much lower reflection density in each color as compared with those in Examples 1 and 2, the image being of foggy tone.

In the above experiments, titanium oxide was used to lower the light transmittance in order to prove the effect of change in light transmittance, in view of the fact that the use of a different color pigment would be reflected in a difference in hue which would be inconvenient from the standpoint of comparison.

In FIGS. 2 to 4, it is noted, mark ◇ indicates the reflection density (ΔOD) of a print image produced by using an ink layer which was formed by applying an ink having a color pigment content equal to that of one used in an ink layer marked ▲, in amount of coating of 2 g/m$^2$ As can be clearly seen from FIGS. 2 to 4, reflection density (ΔOD) varies depending upon the amount of color medium.

In many cases, the thickness of an ink layer is preferably selected so that the total thickness of superimposed prints is about 35 μm or less.

In cases where, not in aforesaid Examples alone, a vehicle or color pigment having good transperency, for example, any of those mentioned below, was used, good results similar to those observed in the above Examples were obtained. Maximal reflection density, light transmittance in non-absorption band, and amount of color medium at which the maximal reflection density was reached varied depending upon the kind of the material used. In every case, however, a maximal or higher level of density was visually observed.

As a color pigment in yellow was used one kind or a mixture of two or more kinds of pigments such as naphthol yellow S, Hansa yellow 5G, permanent yellow NCG, and quinoline yellow lake. Good results were obtained as in Example 1.

As a color pigment in magenta was used one kind or a mixture of two or more kinds of pigments such as brilliant fast scarlet, brilliant carmine BS, permanent carmine FB, lithol red, permanent red F5R, brilliant carmine 6B, pigment scarlet 3B, rhodamine lake B, and alizarin lake. Again, good results were obtained as in Example 1.

As a color pigment in cyan was used one kind or a mixture of two or more kinds of pigments such as Victoria blue lake, metal-free phthalocyanine blue, phthalocyanine blue, and fast sky blue. Again, good results were obtained as in Example 1.

Carbon black or the like was used as a color pigment in black, and in this case, the results were also satisfactory as in Example 1.

With respect to the composition of a vehicle, it is desirable to use solid wax having a penetration of 10 to 30 (at 25° C.) as a binder in order to obtain an improved melt-transferability of ink layers. For example, waxes such as carnauba wax, microcrystalline wax, Japan wax, beeswax, ceresin wax and spermaceti are used. Further, any readily hot-meltable material such as low molecular weight polyethylene, oxidized wax or ester wax may be used in combination.

As a softening agent may be advantageously used any readily hot-meltable material such as petroleum resin, polyvinyl acetate, polystyrene, styrene-butadiene copolymer, cellulose esters, cellulose ethers or acrylic resins, or lubricating oils.

Furthermore, for the purpose of the present invention, it is possible to use a heat-conductive powdery material and/or an extender pigment in order to give good heat-conductivity and melt-transferability to such heat sensitive ink layer.

As such heat-conductive powdery material may be advantageously used aluminum, copper, or zinc, for example, which has a heat-conductivity of $6.0\times10^{-4}$ to $25.0\times10^{-4}$ cal/sec.cm.° C.

As extender pigments may be used colloidal silica, magnesium carbonate, calcium carbonate, clay, kaolin, calcium silicate, highly dispersive silicic acid anhydride (commercially available under the name "Aerosil" made by Nippon Aerosil Kabushiki Kaisha), and white carbon, for example, which all have relatively high transparency.

Such heat-conductive material and extender pigment may be used in an amount of 0 to 30 parts by weight and 0 to 10 parts by weight per 100 parts by weight of the total dry weight of the ink composition for each color, respectively.

It is noted that the combination and amounts of the above ingredients of which the vehicle consists should be selected so that the transparency of the vehicle itself may not be affected adversely.

As a foundation may be used thin papers such as thin condenser paper, insulating condenser paper, one-time carbon base paper, parchment paper, glassine paper, India paper and wax paper; plastic films such as polyester film, polyimide film and polyvinyl chloride film; and cellophane.

The foundation may have a highly heat-resistant resin layer coated thereon in order to prevent sticking or a highly heat-conductive layer coated thereon in order to improve transferability.

The arrangement of ink layers relative to the foundation may not be limited to one such as shown in FIG. 1, but such layers may be arranged in any conventional pattern.

Again, not only is it possible to apply ink layers in different colors on one foundation, but it is possible as well to apply ink layers in different colors to separate foundations on a color by color basis or to change the foundation according to the difference in density.

What is claimed is:

1. A multi-gradation heat sensitive transfer medium for use in multi-gradation thermal transfer for adjusting the density of a transfer print image by superimposing ink layers on a recording medium a plurality of times by thermal transfer, which comprises a foundation and ink layers provided thereon in a side-by-side relationship, each of said ink layers containing a color pigment having a high transparency and a high tinting strength in an amount smaller than sufficient to provide a maximal degree of reflection density, each of said ink layers having a light transmittance of not less than about 65% in a region where the color pigment does not have any absorption band.

2. The transfer medium of claim 1, wherein on single foundation, there are provided ink layers in single color which are different from each other in reflection density.

3. The transfer medium of claim 2, wherein the color is selected from the group consisting of yellow, cyan and magenta.

4. The transfer medium of claim 1, wherein on single foundation, there are provided ink layers in different colors, the ink layers for each color being different from each other in reflection density.

5. The transfer medium of claim 4, wherein the different colors are yellow, cyan and magenta.

* * * * *